United States Patent [19]

Sleep

[11] 4,179,993

[45] Dec. 25, 1979

[54] MATERIAL HANDLING VEHICLE

[75] Inventor: Craig Sleep, Bangor, Pa.

[73] Assignee: SI Handling Systems, Inc., Easton, Pa.

[21] Appl. No.: 870,307

[22] Filed: Jan. 18, 1978

[51] Int. Cl.[2] ..... B61B 10/04

[52] U.S. Cl. ..... 104/172 BT; 104/170

[58] Field of Search ..... 104/172 BT, 88, 140, 104/170

[56] References Cited

U.S. PATENT DOCUMENTS

| | | | |
|---|---|---|---|
| 3,103,895 | 9/1963 | Bradt et al. | 104/172 BT X |
| 3,338,181 | 8/1967 | Dorrance | 104/172 BT X |
| 3,559,584 | 2/1971 | Frantz et al. | 104/88 |
| 3,789,767 | 2/1974 | Krammer | 104/172 BT |
| 3,830,164 | 8/1974 | Biessener | 104/172 BT X |

FOREIGN PATENT DOCUMENTS

| | | | |
|---|---|---|---|
| 896530 | 5/1962 | United Kingdom | 104/172 BT |
| 522108 | 11/1976 | U.S.S.R. | 104/172BT |

*Primary Examiner*—Randolph A. Reese

*Attorney, Agent, or Firm*—Seidel, Gonda, Goldhammer & Panitch

[57] ABSTRACT

A tow line vehicle having a tow pin is provided with a bumper capable of moving the tow pin from an operative position coupled to a tow chain to an inoperative position. The bumper is coupled to the tow pin in a manner so that it does not interfere with the ability of simultaneously raising the tow pin and a selector pin by means of a handle on the vehicle.

9 Claims, 3 Drawing Figures

MATERIAL HANDLING VEHICLE

BACKGROUND

Vehicles of the type involved herein are classified in class 104. See U.S. Pat. Nos. 3,262,397 and 3,559,584 which are typical of prior art patents showing vehicles of the type involved herein. It is conventional to provide a tow vehicle with a bumper capable of disconnecting the tow pin when the bumper is actuated. That is, when the bumper contacts an object, the tow pin is disengaged from the conveyor chain.

A wide variety of devices have been suggested heretofore for converting the movement of the bumper to movement of the tow pin to effect a disengaging of the tow pin from the conveyor chain. Such devices include complex linkages, cams and cam followers, etc. It is also known to provide a handle which facilitates simultaneous elevation of the tow pin and one or more selector pins. When this feature is combined on a vehicle with a bumper adapted to disengage the tow pin, the components of the vehicle are numerous, complicated, expensive and/or are not entirely reliable.

SUMMARY OF THE INVENTION

The present invention is directed to a tow vehicle having a body mounted on wheels. A tow pin is supported by the body and movable from an operative position wherein it can contact the conveyor to an inoperative position. A bumper is mounted on the body and is supported for movement between an extended position and a retracted position.

The bumper is coupled to the tow pin for moving the tow pin from its operative position to its inoperative position when the bumper is in its retracted position. A biasing means is coupled to the bumper for biasing the bumper to its extended position. At least one upright selector pin is supported on the body to one side of the tow pin.

A handle is coupled to the selector pin for moving the selector pin. The handle is also coupled to the tow pin by way of a link having an elongated slot. A pin member extends transversely through said slot and is connected to the bumper. The link is connected to the tow pin so that said pin member can move the tow pin when it engages an end of the slot. The slot is sufficiently long so that the pin member remains in said slot in both the operative and inoperative positions of the tow pin and in both the extended and retracted positions of said bumper.

It is an object of the present invention to provide a tow vehicle having a tow pin structurally interrelated with a bumper in a unique manner which is simple, inexpensive and reliable.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawings in detail, wherein like numerals indicate like elements, there is shown in FIG. 1 a vehicle in accordance with the present invention designated generally as 10.

Figure 1:
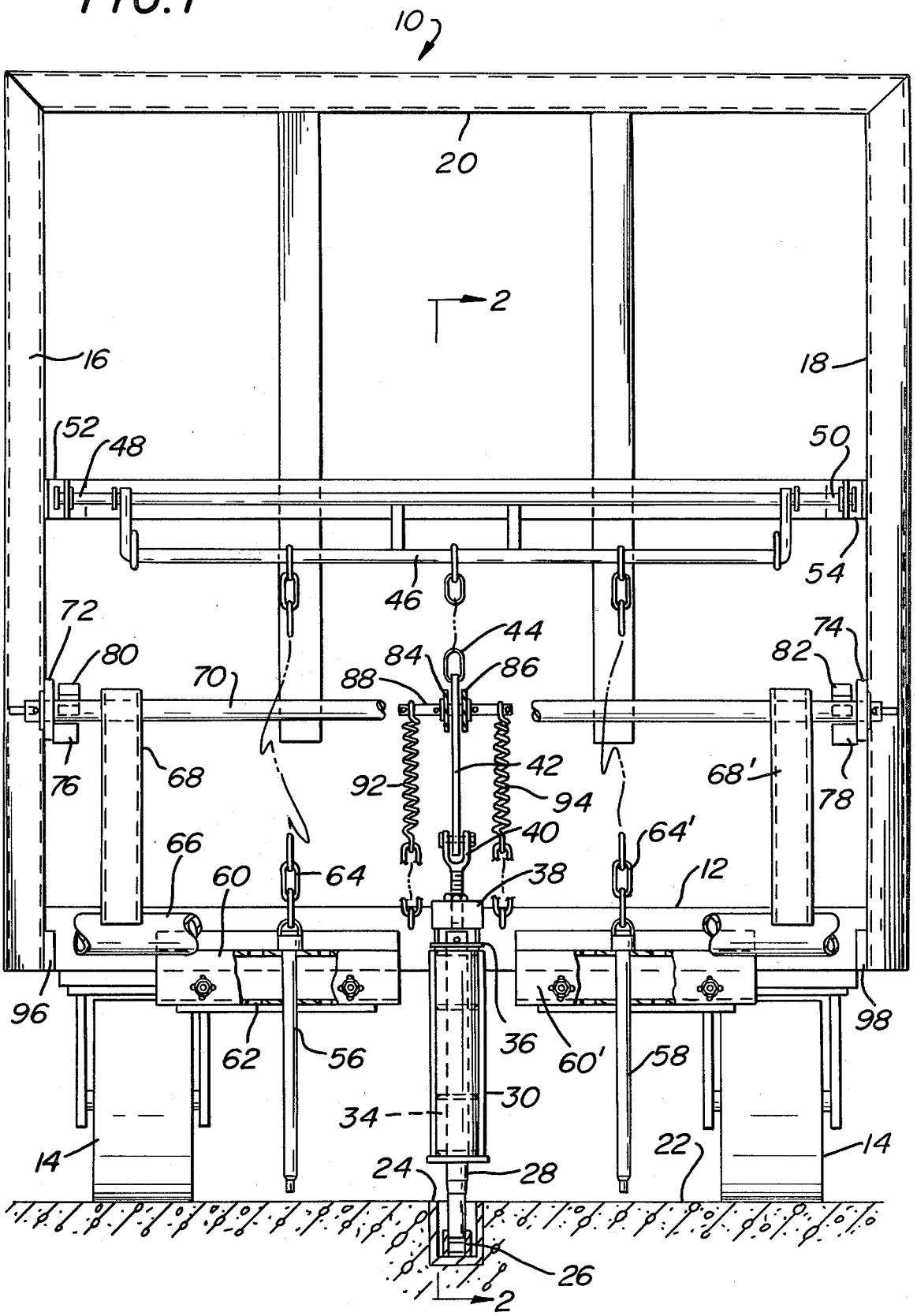
FIG. 1 is a front elevation view of a vehicle in accordance with the present invention with portions broken away for purposes of illustration.

The vehicle 10 is a driverless vehicle adapted to be moved along a fixed path defined by a conveyor chain or other equivalent device. The vehicle 10 includes a platform 12 which is horizontally disposed and supported by a plurality of wheels 14. At one end of the platform 12, there is provided an assembly comprised of vertical standards 16 and 18 interconnected by one or more braces 20.

The surface such as floor 22 is provided with a channel 24 flush therewith. Within the channel 24, there is provided a conveyor line such as a conveyor chain 26. A vertically disposed tow pin 28 is supported at the front end of the vehicle 10. The tow pin 28 is gravity biased downwardly into contact with the conveyor chain 26. When the tow pin 28 is engaged by a dog or other surface on the chain 26, it propels the vehicle 10 along the floor 22.

The tow pin 28 is supported and guided for vertical movement by way of a housing 30. Housing 30 is connected to the front end of the platform 12 adjacent the center thereof. One or more brackets 32 interconnect the housing 30 with the platform 12. The housing 30 is preferably provided with shock bushings 34 adjacent its ends and through which tow pin 28 extends. The lowermost position of the tow pin 28 is determined by contact between the upper end of the housing 30 and a flange 36 or equivalent structure on the tow pin. If desired, a weight 38 surrounds the upper end of the tow pin 28. Weight 38 is preferably easily removed so that different size weights may be utilized in accordance with any particular objectives of a system in which the vehicle 10 is to be used.

A clevis 40 is threadedly coupled to the upper end of the tow pin 28 to facilitate adjustment therebetween. The clevis 40 is connected to one end of a link 42. The other end of link 42 is connected by way of a flexible member such as chain 44 to a handle 46. The handle 46 has offset end portions 48, 50 which are rotatably supported by brackets 52, 54 respectively. Bracket 52 is supported by standard 16. Bracket 54 is supported by standard 18.

At least one and preferably two selector pins are suppoted by the vehicle 10. As shown, selector pins 56 and 58 are provided. The selector pins are on opposite sides of the tow pin 28. The selector pins may be of any type for mechanically actuating a switch or the like. Alternatively, the selector pins may be provided with a magnet for actuating electrical switches. The selector pins 56, 58 are identical. Only selector pin 56 will be described in detail with corresponding elements having corresponding primed numerals.

At the front of the vehicle 10, to one side of the tow pin 28, there is provided a channel-shaped housing 60 having top and bottom walls. The top and bottom walls are provided with sets of aligned holes 62 at spaced points therealong. Housing 60' is provided with mating sets of holes at comparable distances from the tow pin 28. The upper end of selector pin 56 is provided with an enlarged head to limit the downward extent of the pin. The enlarged head is connected to the handle 46 by a flexible member such as chain 64.

The vehicle 10 is provided with a bumper 66 at the front end thereof. Bumper 66 is preferably a piece of hollow tubing and is connected to a shaft 70 by way of struts 68, 68'. Shaft 70 is rotatably supported at one end by brackets 72 on standard 16. The other end of shaft 70 is supported by bracket 74 on standard 18.

Figure 2:
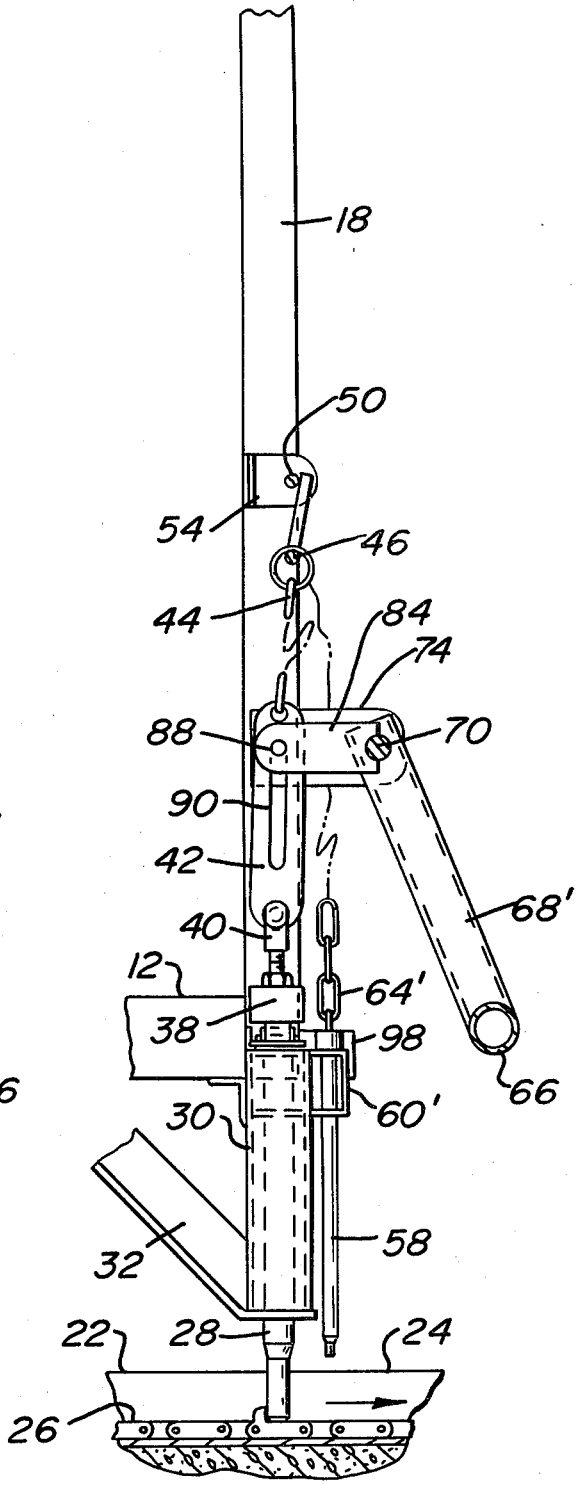
FIG. 2 is a sectional view taken along the line 2—2 in FIG. 1 and showing only the front end of the vehicle.

The bracket 72 is provided with a fixed limit stop 76. Bracket 74 is provided with a fixed limit stop 78. A tab 80 is secured to shaft 70 adjacent bracket 72. Tab 82 is secured to shaft 70 adjacent bracket 74. When bumper 66 is in its forwardmost position as shown in FIG. 2, tab 80 contacts limit stop 76 and tab 82 contacts limit stop 78. In such position, the bumper 66, struts 68, 68' form an acute angle with respect to a vertical. Angle $\alpha$ is approximately 25°. The struts 68, 68' are vertically disposed in the retracted position of the bumper.

A pair of extension plates 84, 86 are secured to the shaft 70. Link 42 is disposed between the free ends of the plates 84, 86. A pin member 88 extends through aligned holes in the plates 84, 86 and through an elongated slot 90 in the link 42. The lower end of link 42 is pivotably connected to the clevis 40. The upper end of link 42 is loosely connected to one of the links of chain 44.

A spring 92 is connected to one end of pin member 88. A spring 94 is connected to the other end of pin member 88. The springs 92, 94 are anchored to the body of the vehicle 10 at any convenient location by way of chains forming an extension thereof. The springs 92, 94 are under tension so as to bias the bumper 66 in the position shown in FIG. 2. A limit stop 96 is secured to the standard 16. A limit stop 98 is secured to the standard 18. The limit stops 96, 98 project forwardly of the vehicle beyond the vertical side faces of the housing 60, 60' at the elevation of bumper 66 shown in phantom in FIG. 3. Thus, the bumper 66 is in an extended position as shown in FIG. 2.

While the vehicle 10 is being propelled by the conveyor chain 26 along a path defined by channel 24, as shown in FIG. 2, the bumper 66 is in its extended position and is biased thereto by the springs 92, 94. While using struts 68, 68' having a length of about 1 foot, I found that the distance between the extended and retracted positions of the bumper 66 may be as small as 5 inches and during which travel the tow pin 28 will be elevated so as to have its lowermost end disposed within the channel 24 but out of contact with the conveyor chain 26. It is highly advantageous to have a bumper which does not project very far out in front of the vehicle 10 and yet is capable of disengaging the tow pin from the conveyor with only a short length of travel for the bumper. Thus, with the pin member 88 in contact with the upper end of slot 90 as shown in FIG. 2, movement from right to left by the bumper 66 due to contact with an object will raise the link 42 and tow pin 28 sufficient so as to disengage the tow pin 28 from the conveyor chain 26. While disengaged from conveyor chain 26 by bumper 66, tow pin 28 remains in channel 24.

Figure 3:
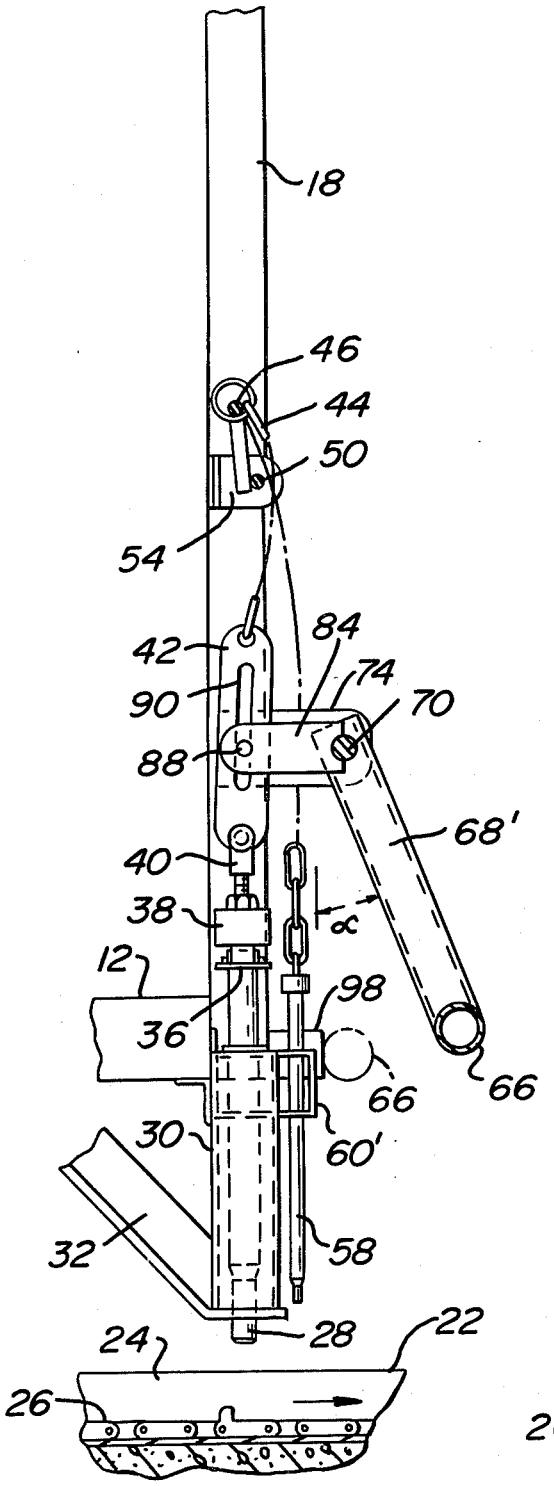
FIG. 3 is a view similar to FIG. 2 but showing the selector pin and tow pin in an elevated position.

At the same time, the tow pin 28 and the selector pins 56, 58 are interrelated with the handle 46 whereby they may be simultaneously elevated. Thus, when handle 46 is rotated through an arc of approximately 180° from the position shown in FIG. 2 to the position shown in FIG. 3, the tow pin 28 an the selector pins 56, 58 are elevated to the storage position shown in FIG. 3. The storage position of the tow pin 28 as shown in FIG. 3 is above the elevation of the tow pin 28 attained by actuation of bumper 66 and does not in any way interfere with the bumper 66 being permitted to remain in its extended position. Thus, pin member 88 remains within slot 90 in all positions of the tow pin 28 and in all positions of the bumper 66. By using commercially available components such as chains, clevises, etc., machining of components is minimized.

With the components structurally interrelated as described above and shown in the drawings, the bumper in its extended position projects forwardly beyond the front face of the standard 16, 18 by a distance less than 12 inches. Link 42 in a preferred operative embodiment is of substantial length such as 9 inches with the slot 90 having a length of about 5 inches. Adjustment for various circumstances is readily attained by adjusting the threaded connection between clevis 40 and the tow pin 28. All components to be adjusted are exposed for ready access and maintenance.

The present invention may be embodied in other specific forms without departing from the spirit or essential attributes thereof and, accordingly, reference should be made to the appended claims, rather than to the foregoing specification as indicating the scope of the invention.

I claim:

1. In a tow vehicle comprising a body mounted on wheels, a tow pin on said body and movable upwardly from an operative position wherein it can contact a conveyor to an inoperative position wherein it is out of contact with a conveyor, a bumper movably mounted on the body for movement between an extended position and a retracted position, said bumper being coupled to said tow pin for moving said tow pin from its operative position to its inoperative position as said bumper moves to its retracted position, means biasing said bumper to its extended position, means on said body independent of said bumper for elevating the tow pin to an elevation above said inoperative position including a link having an elongated slot, a member extending transversely through said slot and connected to said bumper, one end of said link is at an elevation above and pivotably connected to the upper end of said tow pin, said elevating means including a handle, said link being connected to said handle by way of a flexible chain or the like, said link being connected to said tow pin so that said member can move the tow pin when it engages an end of said slot, said slot being sufficiently long so that said member remains in said slot in both the operative and inoperative positions of said tow pin and in both the extended and retracted positions of said bumper.

2. In a vehicle in accordance with claim 1 wherein said means biasing said bumper to its extended position is connected to said member.

3. In a vehicle in accordance with claim 1 wherein said handle is supported by said vehicle for rotation about a horizontal axis through an arc of approximately 180° from a lowermost position to an uppermost position, said handle elevating said tow pin when the handle is moved to its uppermost position.

4. In a vehicle in accordance with claim 1 including at least one selector pin supported by said vehicle, said selector pin being generally parallel to said tow pin and disposed to one side thereof, flexible means interconnecting said handle and said selector pin whereby said selector pin and tow pin are simultaneously elevated by said handle as the handle is moved between upper and lower positions.

5. Apparatus comprising a vehicle having a generally upright tow pin at one end thereof, a bumper at said one end of said vehicle, spring means biasing said bumper to an extended position, said bumper being movable to a retracted position upon contact with an object, means for causing such movement of the bumper to elevate the tow pin, said means including a link at an elevation above and pivotably connected to the upper end of said tow pin, said link having an elongated slot, a pin member extending tranversely through said slot and being connected to said bumper for movement therewith so that said member can elevate the link and tow pin when the member engages one end of the slot, said slot being sufficiently long so that said member remains in said slot in the extended and retracted positions of said bumper and in both operative and inoperative elevations of said tow pin.

6. Apparatus in accordance with claim 5 including a handle pivotably supported by said vehicle at an elevation above the elevation of said link, said link being connected to said handle by a flexible chain or the like, a selector pin supported by said vehicle to one side of said tow pin, said selector pin being connected to said handle by a flexible chain or the like, whereby pivotable movement of said handle simultaneously elevates said selector pin and tow pin.

7. Apparatus in accordance with claim 5 wherein said link is pivotably connected to a device which in turn is adjustably connected to the upper end of said tow pin so that the ends of the slot in said link may be adjusted with respect to said pin member.

8. Apparatus in accordance with claim 5 wherein said bumper projects forwardly of said vehicle by a distance of not more than about 12 inches, and said bumper elevating said tow pin from an operative position to an inoperative position with only about 5 inches of travel of the bumper in a direction toward said one end of said vehicle, and said bumper being pivotably supported by said vehicle at an elevation above the upper end of said tow pin and adjacent said link in all positions of said link.

9. Apparatus comprising a vehicle having an upright tow pin at one end thereof, a bumper at said one end of said vehicle, means biasing said bumper to an extended position, said bumper being movable to a retracted position upon contact with an object, means for causing such movement of the bumper to elevate the tow pin, said means including a link connected to the upper end of said tow pin, said link having a elongated slot, a pin member extending transversely through said slot and being connected to said bumper for movement therewith so that said member can elevate the link and tow pin when the member engages one end of the slot, said slot being sufficiently long so that said member remains in said slot in the extended and retracted positions of said bumper and in both operative and inoperative elevations of said tow pin, said bumper being pivotably supported by said vehicle with the elevation of the axis of said bumper being approximately the same elevation as said pin member when said bumper is in its extended position.

* * * * *